US005437563A

United States Patent [19]

Kihira et al.

[11] Patent Number: 5,437,563

[45] Date of Patent: Aug. 1, 1995

[54] WATER-PROOF SHIELDED CONNECTOR

[75] Inventors: Soji Kihira; Fumiyoshi Tanigawa; Masahide Hio, all of Yokkaichi, Japan

[73] Assignee: Sumitomo Wiring Systems, Ltd., Yokkaichi, Japan

[21] Appl. No.: 253,583

[22] Filed: Jun. 3, 1994

Related U.S. Application Data

[63] Continuation of Ser. No. 994,695, Dec. 22, 1992, abandoned.

[30] Foreign Application Priority Data

Dec. 25, 1991 [JP] Japan ..... 3-106918 U

[51] Int. Cl.[6] ..... H01R 13/648

[52] U.S. Cl. ..... 439/607; 439/275

[58] Field of Search ..... 439/271–283, 439/578–585, 607, 609, 610

[56] References Cited

U.S. PATENT DOCUMENTS 4,269,469 5/1981 Audic .
4,349,241 9/1982 Juris et al. ..... 439/609
4,611,873 9/1986 Punako et al. ..... 439/578
4,896,939 1/1990 O'Brien ..... 439/578
4,925,404 5/1990 Duttcher ..... 439/610
4,975,085 12/1990 Cartessi et al. ..... 439/609
5,046,964 9/1991 Welsh et al. ..... 439/609
5,306,195 4/1994 Hayashi .

*Primary Examiner*—David L. Pirlot
*Attorney, Agent, or Firm*—Sandler, Greenblum & Bernstein

[57] ABSTRACT

A connector of shielding wire composed of a shielding cover and a protective cover put on with respect to the connector housing to be connected with the shielding wire is engaged with the female, male opposite type connector. A rubber ring for sealing use is interposed between the opposite engaging faces of the mutually engaging connector housing, shielding cover or/and the protective cover, and a rubber plug or a sealing resin is interposed between the electric wire inserting portion of the connector housing, the shielding cover or/and the protective cover, and the shielding wire.

7 Claims, 7 Drawing Sheets

WATER-PROOF SHIELDED CONNECTOR

This application is a continuation of application Ser. No. 07/994,695, filed Dec. 22, 1992, now abandoned.

BACKGROUND OF THE INVENTION

The present invention generally relates to a water-proof shielding connector to be used in a wire harness or the like for motorcar use, and more particularly, to provide a water-proof function for a connector for connecting a shielding wire to be wired within an engine compartment, etc. of a motorcar.

In recent years, circuits for sensor systems have suddenly increased in number because of an increase in battery-related products to be mounted on the motorcar. Shielding wires and shielding connectors to be mounted on the shielding wires are often used so as to protect signal wires from external noises for preventing errors.

Conventionally, in the connector connecting portion of this type of shielding wire, a shielding wire 1 is extended through a protective cover 2 made of insulating materials as shown in FIG. 9 and FIG. 10. A terminal 5 is made to adhere under pressure onto a conductor of each core 3 branched from the tip end with respect to the shielding wire 1 extended through the protective cover 2. Each terminal 5 is inserted into each terminal accommodating chamber *7a* of a connector housing 7. Thereafter, the connector 7 is set within a shielding cover 6 made of conductive materials, and a shield of the shielding wire 1 connects with a shielding cover 6 by solder. Thereafter, the shielding wire 1 slides in a rearward direction as shown by arrow X of FIG. 10. A connector housing 7 and a shielding cover 6 connected with the tip end of the shielding wire 1 are set within the protective cover 2.

In the above described conventional shielding connector, a water-proof function is not especially provided. The conventional shielding connector is defenseless with respect to inundation of moisture from the engagement opening *2a* and the electric wire insertion opening *2b* of the protective cover 2.

Naturally, water is attracted to terminals along the sheath and core of the shielding wire. Reliability with respect to the electric connecting performance (connection resistance, leakage electric current or the like) is lowered. Therefore, a complete water-proof operation is required to be effected in the connecting portion between the shielding wire and the protective cover or in the connection portion between the core and the connector housing.

It is necessary to provide the shielding connector with a water-proof function in this manner. Especially, it is indispensable to make water-proof measure to the connecting portion of the shielding wire to be arranged within the engine compartment.

SUMMARY OF THE INVENTION

Accordingly, the present invention has been developed with a view to substantially eliminating the above-discussed drawbacks inherent in the prior art, and has for its essential object to provide an improved water-proof shielding connector.

Another important object of the present invention is to provide a water-proof function for a connecting connector of the shielding wires.

In accomplishing these and other objects of the present invention, there is provided a water-proof shielding connector where a connector housing accommodating within each of its terminal accommodating chambers a terminal provided at the end of each core disposed from the end of a shielding wire is covered with a shield cover made of conductive materials, and both the connector housing and shield cover are respectively engaged with the counterpart connector housing and shield cover of the terminal connection side.

The connector includes a first sealing member provided between the engaging planes of connector housings, the shield covers, or the connector housing and shield cover engaging with each other.

A second sealing member is provided between the shielding wire and a wire inserting portion of the shield cover and/or connector housing.

Further, there is provided a water-proof shielding connector where a connector housing accommodating within each of its terminal accommodating chambers a terminal provided at the end of each core disposed from the end of a shielding wire is covered with a shield cover made of conductive materials which is covered by a protective cover made of insulating material, and the connector housing, shield cover and protective cover are respectively engaged with the counterpart connector housing, shield cover and protective cover of terminal connecting side.

The connector includes a first sealing member provided among the engaging planes of connector housings, shield covers and/or protective covers engaging with each other.

A second sealing member is provided between the shielding wire and a wire inserting portion of the connecting housing, shield cover and/or protective cover.

The above described rubber ring, rubber plug, the filling portion of a sealing material composed of hardening resin or the like for sealing use are properly selected in accordance with the construction of the connector for connecting a shielding wire.

In the water-proof shielding connector, the first sealing member is provided between the top end planes or the round portions of protective covers engaging and facing each other, and the second shielding member is provided between the shielding wire and a wire inserting portion of the protective cover.

The first sealing cover is preferably provided between the round portions of a pair of male and female protective covers facing each other at its outer periphery side and inner periphery side, the pair of protective covers being engaged with each other.

The first sealing member may engage with the male protective cover while being secured on the inner periphery plane of a female protective cover in advance so as to depress the outer periphery plane of the male protective cover, or engaging with the female protective cover while being secured on the inner periphery plane of the male protective cover in advance so as to depress the inner periphery plane of the female protective cover.

Further, in the water-proof shielding connector, the first sealing member is provided between the top end or round portions of the connector housings to engage and face each other, and the second sealing member is provided between the core of the shielding wire and the wire inserting portion of the connector housing.

The first sealing member is preferably provided between the round portions of a pair of male connector housing and female connector housing engaging and facing each other at its outer periphery side and inner periphery side.

The first sealing member is secured in advance to the inner periphery plane of a periphery wall projected toward the female terminal connecting portion side of the connector housing at the male terminal accommodating side so as to be depressed onto the outer periphery of the connector housing at the female terminal accommodating side.

Another first sealing member may be secured in advance to the outer periphery plane of a periphery wall projected toward the male terminal connecting portion side of the connector housing at the female terminal accommodating side so as to be depressed onto the inner periphery of the connector housing at the male terminal accommodating side.

The thermosetting or ultraviolet setting resin may be injected into the electric wire inserting portion so as to effect a sealing operation with respect to the electric wire inserting portion after the completion of assembling with the connector of either of the above described construction.

A sealing member such as rubber ring or the like is interposed in a gap in the electric wire inserting portion with respect to the protective cover, the shielding cover and/or the connector housing, and further in a gap to be formed on the engaging face of the protective cover, the shielding cover and/or connector housing to be mutually engaged, so as to effect a water-proof operation, and so that inundation with respect to the terminal connecting portion can be positively prevented.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE INVENTION

Figure 1:
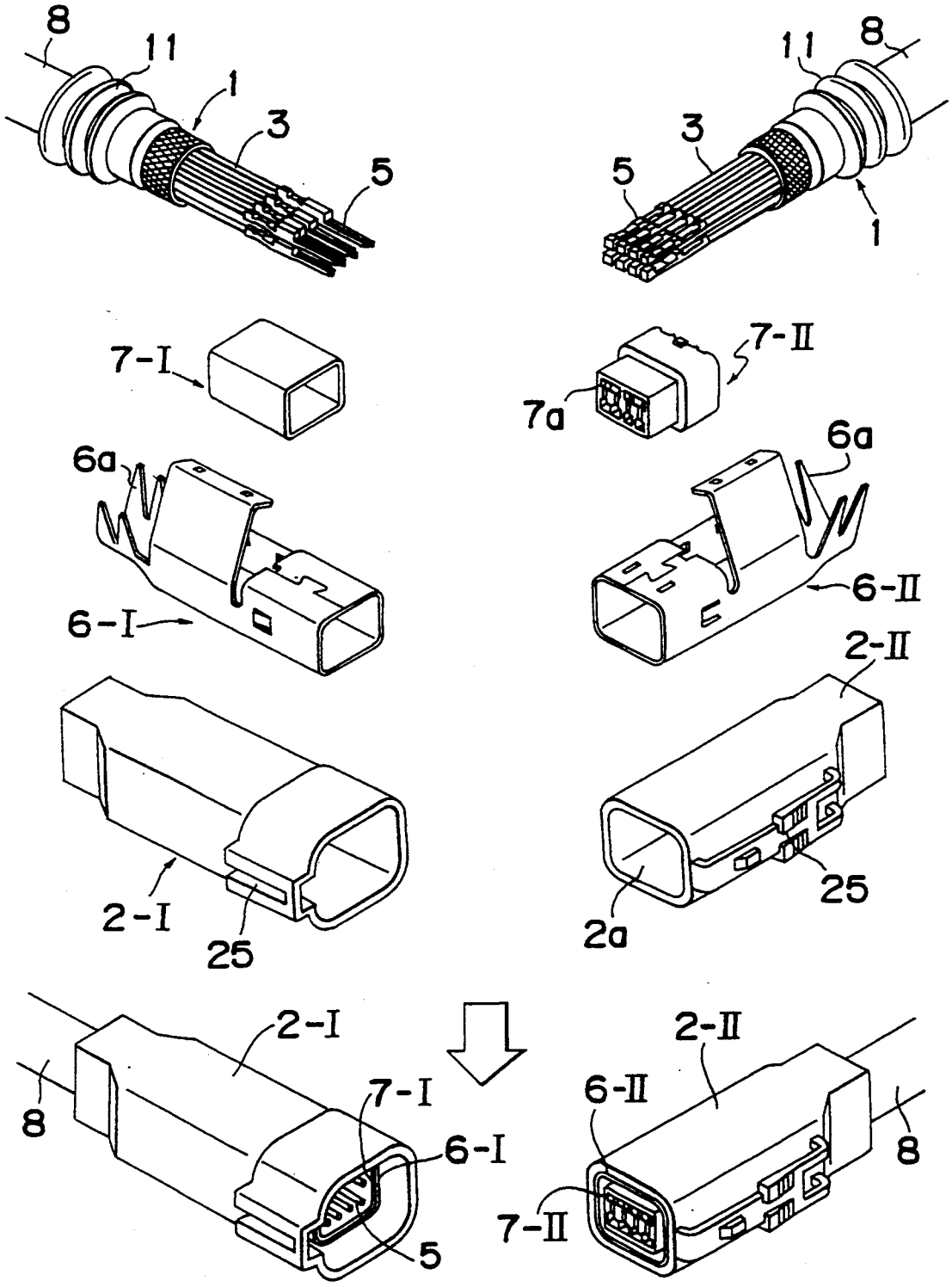
FIG 1 is an exploded perspective view of a first embodiment of the present invention.

Before the description of the present invention proceeds, it is to be noted that like parts are designated by like reference numerals throughout the accompanying drawings.

The present invention will be described hereinafter in detail with reference to an embodiment shown in the drawings.

The shielding wire and the terminal adhered under pressure onto the tip end of the shielding wire are the same in construction as discussed above. The connector housing to be connected with the above described terminal being accommodated therein, a shielding cover made of conductive materials externally engaged with the connector housing, and the protective cover made of insulating materials to be externally engaged with the shielding cover are almost similar in construction to the conventional embodiment described in FIG. 9 except for the sealing member as mounted.

Figure 2:
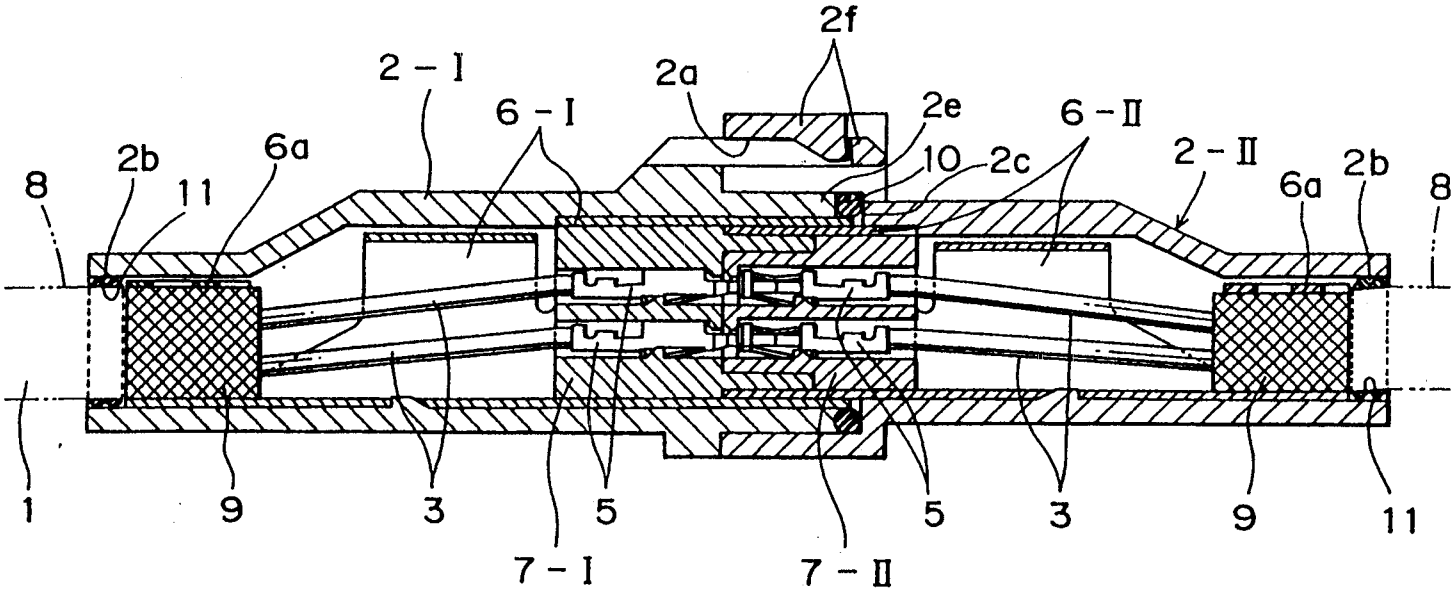
FIG. 2 is a sectional view showing an engaging condition in the first embodiment.

FIG. 1 and FIG. 2 show a first embodiment. In the first embodiment, a sealing rubber ring 10 is interposed between the engaging faces of the male and female protective covers 2 (2-I and 2-II) to be engaged with each other and also, a rubber plug 11 externally engaged with the sheath 8 of the shielding wire 1 is made to adhere on the inner peripheral face of the shielding wire inserting opening 2*b* of each of the above described female and male protective covers 2.

A sealing member composed of the above described rubber ring 10 and the rubber plug 11 is set in advance before the engagement. A sealing rubber ring 10 is stuck on the end face of the connecting stage portion 2*c* with either of the above described protective covers 2. A female side protective cover is formed on the inner peripheral face of the opening portion 2*a* into which the opposite type male side protective cover 2-I of the female side protective cover 2-II is externally engaged in the present embodiment. Also, the rubber plug 11 mounted on the shielding wire 1 is also made to adhere on the sheath 8 of the shielding wire 1 in advance and is externally engaged therewith.

Figure 9:
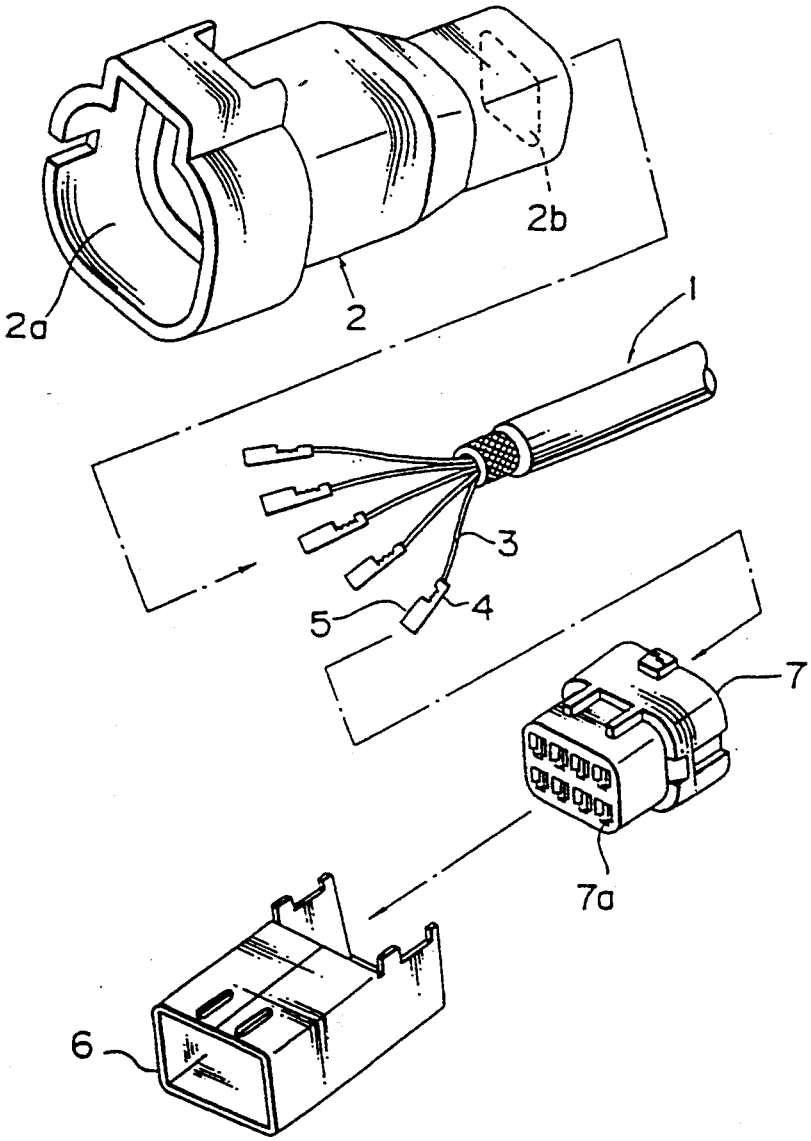
Fig. 9 PRIOR ART
FIG. 9 is an exploded perspective view of a connector connecting operation of the conventional shielding wire and FIG. 10 is a schematic front view showing a condition at the time of engagement of the connector of FIG. 9.
Figure 10:
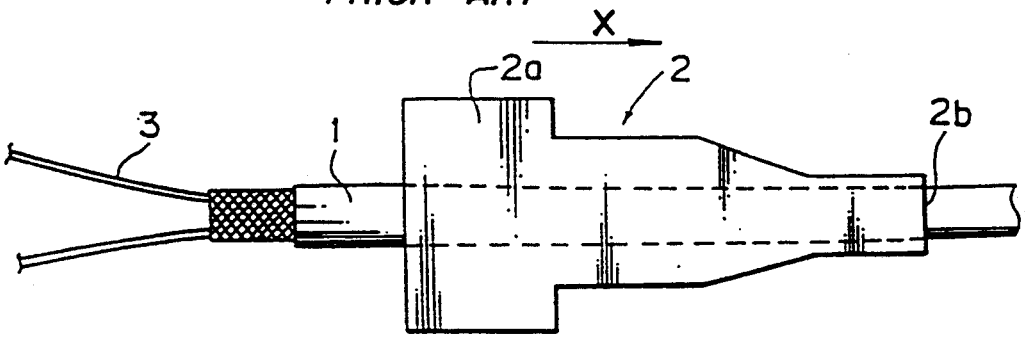
Fig. 10 PRIOR ART

The water-proof connector assembling operation is effected by the same procedure as that in a method described in accordance with the above described FIG. 9. First, the shielding wire 1 is extended through the protective cover 2. The terminal 5 is made to adhere on a conductor of the core 3 branched from the tip end of the shielding wire projected from the tip end opening 2*a* of the protective cover 2. At this time, the rubber plug 11 is positioned on the cut end portion of the disconnected sheath 8.

The terminal 5 made to adhere under pressure onto the tip end of each core 3 of the above described shielding wire 1 is inserted into the terminal accommodating chamber 7*a* of the connector housing 7. Then, the connector housing 7 is inserted into the shielding cover 6 with the rear end barrel 6*a* of the shielding cover 6 adhering under pressure onto the shield 9 of the shielding wire 1.

Thereafter, the shielding cover 6 with the connector housing 7 being accommodated in it is engaged into the protective cover 2 by a rearward pulling operation of the shielding wire 1. The rubber plug 11 of the shielding wire 1 mounted on the connector housing 7 is in pressure contact against the inner peripheral face of the electric wire inserting opening 2*b* of the protective cover 2 with the connector housing 7 and the shielding cover 6 being set in a given position within the protective cover 2.

The connector housing 7-I and the shielding cover 6-I, the connector housing 7-II and the shielding cover 6-II, which are respectively assembled as above described, are engaged with each other as shown in FIG. 2.

At the above described engaging time, the outer peripheral tip of the end face 2*e* of the male side protective cover 2-I is inserted into the opening 2*a* of the female side protective cover 2-II to come into pressure contact against the rubber ring 10 and comes into contact with the connecting stage portion 2*c* through the rubber ring 10. Thus, the sealing operation of the engaging face between the protective covers 2 is effected. The above described female and male protective covers 2 are locked mutually with an engaging portion 2*f* formed on the top face, and is secured in a condition sealed with the rubber ring 10 as described hereinabove.

In the first embodiment, the gap to be caused between the engaging faces of the female and male protective covers is sealed by the rubber ring 10 in a protective cover to be put on the outermost side, and is sealed with the rubber plug 11 in the insertion opening of the shielding wire 1 with respect to the female and male protective covers 2. Thus, inundation of moisture into the protective cover to be engaged with each other can be positively prevented.

Figure 3:
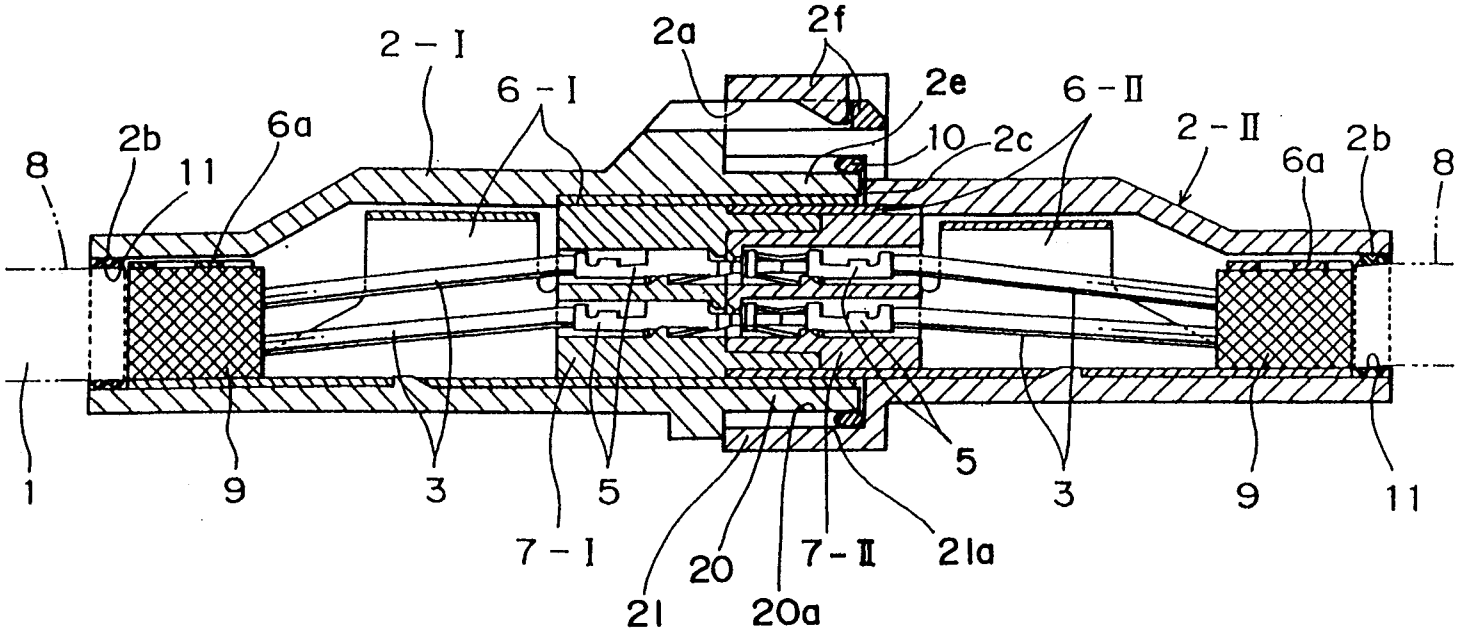
FIG. 3 is a sectional view showing an engaging condition in the second embodiment of the present invention.

FIG. 3 shows a second embodiment of the present invention, wherein there is provided a rubber ring 10 of the first sealing member between the round portions of a pair of a male side protective cover 2-I and a female side protective cover 2-II engaging with each other. In particular, the rubber ring 10 is inserted between the outer periphery plane 20*a* of ring type engaging wall 20 of the male protective cover 2-I and the inner periphery plane 21*a* of ring type engaging wall 21 of the female protective cover 2-II.

The rubber ring 10 is adapted to be assembled in advance onto the inner periphery plane 21*a* of engaging wall 21 of the female protective cover 2-II, and, with this condition, is engaged outwardly with the engaging wall 20 of the male protective cover 2-II, thereby depressing the rubber ring 10 onto the outer periphery 20*a* of engaging wall 20 to provide a waterproof state.

Also, the same state of water-proofing may be provided in another arrangement where the rubber ring 10 is adapted to be mounted in advance onto the outer periphery 20*a* of engaging wall 20 of the male protective cover 2-I, and then is engaged inwardly with the engaging wall 21 of the female protective cover 2-II.

Figure 4:
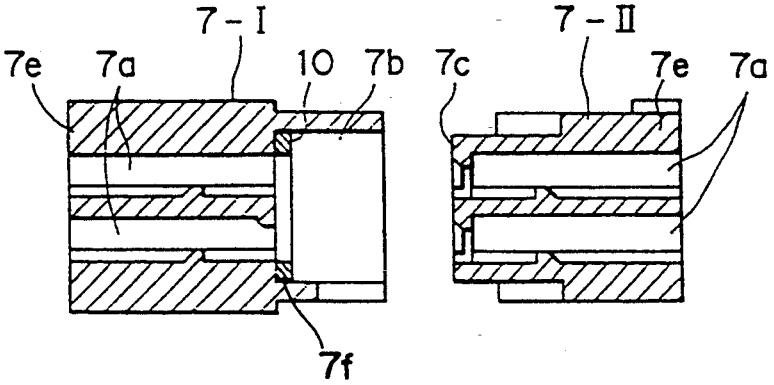
FIG. 4 is a sectional view of a connector housing to be used in a third embodiment of the present invention.
Figure 5:
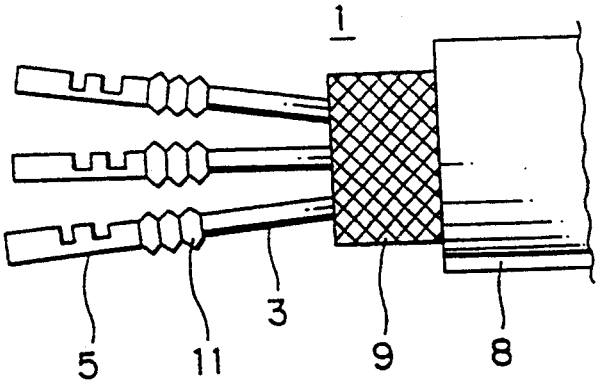
FIG. 5 is a schematic front view of a shielding wire to be used in the third embodiment.

FIG. 4 and FIG. 5 show a third embodiment. In the third embodiment, a rubber ring 10 is interposed on the engagement face of the female and male connector housing 7 to effect the sealing operation of the housing engaging face, and also, the rubber plug 11 is interposed between the electric wire inserting portion of the connector housing 7 and the outer peripheral face of the core to effect the sealing operation of the electric wire inserting operation.

As shown in FIG. 4, the rubber ring 10 is set in advance on the inner peripheral plane of the wall 7*f* surrounding the engaging portion 7*b* into which the male side connector housing 7-II of the female side connector housing 7-I is inserted. When the male side connector housing 7-II is inserted into the engaging portion 7*b*, the outer peripheral tip end face 7*c* comes into pressure contact against the rubber ring 10 so as to effect the sealing operation between the female and male connector housing 7.

As shown in FIG. 5, each core 3 which is separated from the tip end of the shielding wire 1 is further stripped off so as to expose the conductor from the tip end of the core 3 to make the terminal 5 adhere on the conductor. The rubber plug 11 for sealing use is mounted on each core 3 before the terminal 5 adheres under pressure so as to make it adhere on the covered outer peripheral face of the core 3.

When the terminal 5 of each core tip end of the above described shielding wire 1 is inserted into the terminal accommodating chamber 7*a* of the connector housing 7, the rubber plug 11 comes into pressure contact against the rear opening end face 7*e* of the terminal accommodating chamber 7*a* so as to seal the gap to be formed in the electric wire inserting portion.

Figure 6:
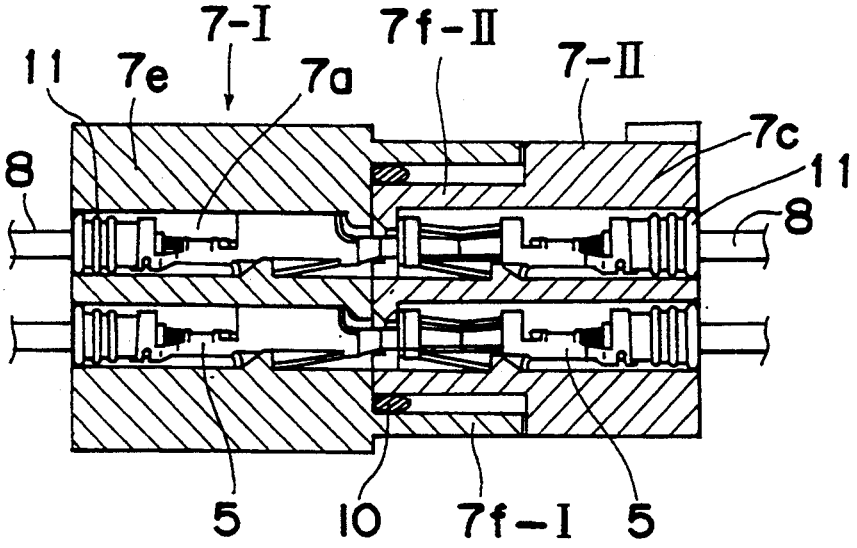
FIG. 6 is a sectional view of a connector housing to be used in a fourth embodiment of the present invention.

FIG. 6 shows a fourth embodiment of the present invention, wherein the rubber ring 10 is mounted in advance onto the outer periphery plane of periphery wall 7*f*-II projected toward the male terminal connecting side of the female connector housing 7-II, and, with this condition, is engaged inwardly with the periphery wall 7*f*-I projected toward the female terminal connecting side of the male connector housing 7-I.

Figure 7:
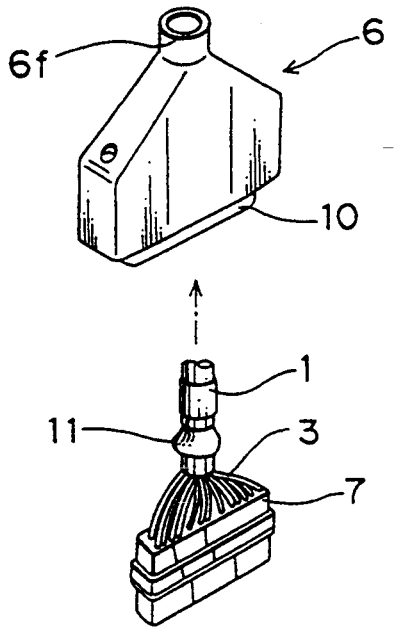
FIG. 7 is a partial exploded perspective view in a fifth embodiment of the present invention.
Figure 8:
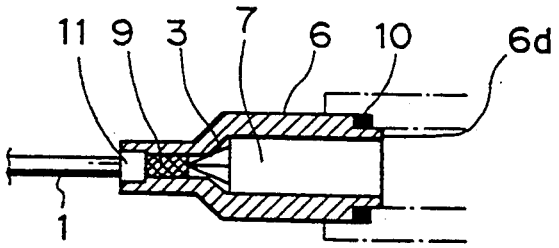
FIG. 8 is a schematic sectional view showing a condition at the time of engagement in the fifth embodiment.

FIG. 7 and FIG. 8 show a fifth embodiment. A deeply contracted or a die casting molded integral type element is used as a shielding cover in the connector of the present embodiment. Also, the protective cover is used without being put on the shielding cover and is used even in the connection of a computer.

The shielding cover 6 is illustrated as a female type. A notch portion 6*d* is formed in the outer peripheral portion on the tip end face to be engaged with the female type with a rubber ring 10 being engaged with the external peripheral face of the notch portion 6*d*. In the engagement with the female type of shielding cover shown with one dot chain line in FIG. 8, the rubber ring 10 effects the sealing operation of the engagement portion.

The sealing operation of the electric wire inserting operation has a rubber plug 11 mounted in advance on the sheath 8 of the shielding wire 1 as shown in FIG. 7.

As the shielding cover 6 is integral, the engaging operation with respect to the shielding cover 6 effects an inserting operation into the shielding cover 6 from below with the shielding wire 1 being connected with the connector housing 7 as shown by an arrow. At this time, the above described rubber plug 11 is pushed in and inserted into the electric wire inserting portion 6f provided in the shielding cover 6. The rubber plug 11 adheres against the inner peripheral face of the electric wire inserting portion 6*f* so as to effect a sealing operation as shown in FIG. 8.

As is clear from the foregoing description, according to the arrangement of the present invention, in a location where the shielding operation is necessary, the sealing property is also demanded, for example, in a connector to be used in the signal wire for the engine control use of the engine compartment, a rubber ring, a rubber plug or a sealing material composed of resin seal is interposed in the gap to be formed between the mutually engaging connectors and in the gap to be formed in the electric wire inserting portion to be mounted on each connector, so that the positive sealing operation can be effected. Both the demands of the shielding property and the sealing property can be met, without increasing costs and with extremely simple construction.

Although the present invention has been fully described by way of example with reference to the accompanying drawings, it is to be noted here that various changes and modifications will be apparent to those skilled in the art. Therefore, unless such changes and modifications depart from the scope of the present invention, they should be construed as included therein.

What is claimed is:

1. A water-proof shielded connector including a first connector housing having accommodating chambers for accommodating a terminal provided at an end of at least one core disposed from an end of a shielded wire, said shielded wire being covered with a shield cover made of conductive materials, and both the connector housing and shield cover are respectively engaged with a counterpart second connector housing and shield cover of a terminal connecting side, said first and second connector housings being a pair of male and female connectors having respective outer and inner periphery portions, said outer and inner periphery portions facing each other, the water-proof shielded connector comprising:

a first sealing member provided in a water-proof sealing relationship between respective said outer and inner periphery portions of said first and second connector housings, wherein said first sealing member is compressed in a radial direction, and a second sealing member provided in a water-proof sealing relationship between the shielded wire and a wire inserting portion of the connector housing.

2. A water-proof shielded connector including a first connector housing having accommodating chambers for accommodating a terminal provided at an end of at least one core disposed from an end of a shielded wire, said shielded wire being covered with a shield cover made of conductive materials which is covered by first and second protective covers made of insulating material, the connector housing, shield cover and protective cover are respectively engaged with a counterpart second connector housing, shield cover and protective cover of a terminal connecting side, said first and second protective covers being a pair of male and female protective covers having respective outer and inner periphery portions, said outer and inner periphery portions facing each other, the water-proof shielded connector comprising:

a first sealing member provided in a water-proof sealing relationship between respective said outer and inner periphery portions of said first and second protective covers, wherein said first sealing member is compressed in a radial direction, and a second sealing member provided in a water-proof sealing relationship between the shielded wire and the protective cover.

3. The water-proof shielded connector as defined in claim 2, wherein the first sealing member is provided between round portions of the respective outer and inner periphery portions of the first and second protective covers.

4. The water-proof shielded connector as defined in claim 3, wherein the first sealing member engages the male protective cover when secured on the inner periphery plane of said female protective cover in advance so as to be depressed by an outer periphery portion of the male protective cover.

5. The water-proof shielded connector as defined in claim 3, wherein the first sealing member engages the female protective cover when secured on the outer periphery plane of said male protective cover in advance so as to be depressed by an inner periphery portion of the female protective cover.

6. The water-proof shielded connector as defined in claim 1, wherein the first sealing member is provided between round portions of respective outer and inner periphery portions of the first and second connector housings, and the second sealing member is provided between the core of the shielded wire and the wire inserting portion of the connector housing.

7. The water-proof shielded connector as defined in claim 6, wherein the first sealing member is secured in advance to an outer periphery portion provided toward the male terminal connecting portion side of the connector housing at the female terminal accommodating side so as to be depressed onto the outer periphery portion of the connector housing at the female terminal accommodating side.

* * * * *

UNITED STATES PATENT AND TRADEMARK OFFICE

CERTIFICATE OF CORRECTION

PATENT NO. : 5,437,563

DATED : August 1, 1995

INVENTOR(S) : SOJI KIHIRA et al.

It is certified that error appears in the above-indentified patent and that said Letters Patent is hereby corrected as shown below:

On the title page, item [56], "References Cited - U.S. PATENT DOCUMENTS", column 2 line 4, change "Duttcher" to ---Dutcher---.

On the title page, item [56], "References Cited - U.S. PATENT DOCUMENTS", column 2 line 5, change "Cartessi" to ---Cartesse---.

Signed and Sealed this

Thirtieth Day of July, 1996

Bruce Lehman

*Attest:*

BRUCE LEHMAN

*Attesting Officer*

*Commissioner of Patents and Trademarks*